United States Patent [19]

Deutsch et al.

[11] 4,022,098

[45] May 10, 1977

[54] KEYBOARD SWITCH DETECT AND ASSIGNOR

[76] Inventors: Ralph Deutsch; Leslie J. Deutsch, both of 3647 Scadlock Lane, Sherman Oaks, Calif. 91403

[22] Filed: Oct. 6, 1975

[21] Appl. No.: 619,615

[52] U.S. Cl. ..... 84/1.03; 84/1.01

[51] Int. Cl.[2] ..... G10F 1/00

[58] Field of Search ..... 84/1.01, 1.03, 1.15, 84/1.24; 340/166 R, 365 R, 365 S

[56] References Cited

UNITED STATES PATENTS

| | | | |
|---|---|---|---|
| 3,700,781 | 10/1972 | Obatashi | 84/1.01 |
| 3,746,773 | 7/1973 | Uetrecht | 84/1.01 |
| 3,752,898 | 8/1973 | Obatashi | 84/1.03 |
| 3,794,747 | 2/1974 | Obatashi | 84/1.01 |
| 3,842,184 | 10/1974 | Kniepkamp et al. | 84/1.24 |
| 3,882,751 | 5/1975 | Tomisaua et al. | 84/1:01 |
| 3,899,951 | 8/1975 | Griffith et al. | 84/1.03 |
| 3,902,397 | 9/1975 | Morez et al. | 84/1.01 |

*Primary Examiner*—L. T. Hix
*Assistant Examiner*—Vit W. Miska
*Attorney, Agent, or Firm*—Ralph Deutsch

[57] ABSTRACT

Keyboard switches are arranged in groups of P switches, Q groups per set, and S sets per keying system. During a search cycle, each group of P switches is sequentially examined to detect a change in a switch state of any member since the preceding search cycle. A change in switch state causes system to enter an assign mode cycle during which a data word is created in memory corresponding to a newly detected switch closure, or is removed from memory corresponding to a newly detected switch opening. Provision is incorporated for coupling between switch groups and switch sets. After an assignment has been completed, system returns to a search cycle. The system is particularly useful in a keyboard musical instrument.

22 Claims, 6 Drawing Figures

20a
20b
20r
130a
130b
130r
28a
28b
28r
31a
31b
31r
22a
22b
22r
25a
25b
25r
13
12
11
10
14
15
16
17
18
19
34
35
45
46
36
37
38
39
40
41
42
43
44

MASTER CLOCK
CLOCK COUNTER MODULO 12
GROUP COUNTER MODULO 6
DIVISION COUNTER MODULO 3
COMPARATOR
ASSIGNMENT MEMORY
MEMORY ADDRESS / DATA WRITE
SAME
STATE FLIP-FLOP
NOTE COUNTER MODULO 12
ASSIGNMENT FLIP-FLOP
HALT INC.
C REGISTER
C# REGISTER
B REGISTER
GATE

KEYBOARD SWITCH DETECT AND ASSIGNOR

BACKGROUND OF THE INVENTION

1. Field of the Invention

The present invention relates to a keyboard switch detect and assignor system useful in a keyboard musical instrument.

2. Related Applications

This invention is related to the inventors' copending U.S. patent application 603,776 filed on Aug. 11, 1975 entitled POLYPHONIC TONE SYNTHESIZER.

3. Description of the Prior Art

In an electronic keyboard instrument of the digital tone generation variety, a significant cost arises if a tone generating system were available for each switch on a keyboard as is customarily used for analog tone generation systems. Therefore in digital tone generation systems such as DIGITAL ORGAN described in U.S. Pat. No. 3,515,792, COMPUTOR ORGAN described in U.S. Pat. No. 3,809,786, and POLYPHONIC TONE SYNTHESIZER described in copending U.S. patent application Ser. No. 603,776 the number of tone generation subsystems is advantageously 12 while the number of keyboard switches may be 147. For low cost implementation a means must be incorporated for assigning 12 tone generators on demand to 147 keyboard switches.

Another problem arising in the economical construction of commercially viable digital tone generators is the desire to use batch fabricated, digital microelectronic techniques. Typically, such microelectronic device packages have about 40 leads which is not consistent with the 147 switches whose states must be transferred to these devices.

One approach to the problem of the limited number of leads available on a microelectronics device package is to use time division multiplexing of the key states of the musical instrument. With this technique a unique time slot is irrevocably assigned to each keyboard switch. The state of each such switch is indicated by the presence or absence of a signal pulse in the time slot assigned to the switch. The advantage of time division multiplexing is that the entire status of all the instruments's keyboard switches can be transmitted on a single signal lead. A drawback of time division multiplexing is that the scanning or search time for the instrument is fixed and is independent of the number of switches that have been closed. this fixed time can be undesirable because the wasted time used to sequentially scan an entire array of switches can lead to loss of key state detection when the musician plays very fast.

A time division multiplex note selection is shown by Watson in the U.S. Pat. No. 3,610,799. There all the keyboard switch state information is combined into unique time slots on a single multiplex line. The total scanning time required is K $t$, where K is the number of switches and $t$ is the time slot allotted to each switch.

Klann disclosed a time division multiplexing system in U.S. Pat. No. 3,614,287 which includes provision for intermanual coupling. By pulse controlled sequential connection of manual coupling and keyboard switches an economy in wiring is obtained and keys actuated on one keyboard can cause voices to sound which are associated with the same or another keyboard.

Pearson, in U.S. Pat. No. 2,989,885 discloses a system for commutating separate waveform generator outputs onto a single line for subsequent processing by a single waveform shaper and sound system. There, delay line commutation, at a rate which is high in comparison to the frequency of the generated tones, is used to mix the outputs of key-switch selected waveform generators onto a common line. Pearson's technique allows the use of common tone generation circuits but requires a separate line from each waveform generator to the associated keyboard switch.

Deutsch and Griffith, in U.S. Pat. No. 3,899,951 disclose a key switch scanning and encoding system for a musical instrument in which open switches may be scanned at a faster rate than closed switches. A coded signal is created for each detected closed switch. The key switches are arranged in a matrix of M groups, each connected to N common output lines. The switch groups are enabled sequentially, one at a time. As each group of switches is enabled, the N output lines sequentially are gated to the coding matrix. If the gated line is associated with a closed switch in the enabled group, an output code is produced by the code matrix, which, together with a signal designating the enabled group, uniquely identifies the closed switch. If an open switch is scanned, no code is produced by the code matrix. This no-code condition immediately causes the next switch matrix output line to be gated to the code matrix. In this manner, open switches are "skipped over" or scanned at a rapid rate.

An object of the present invention is to provide a system for detecting the change of state of key switches in a keyboard musical instrument and causing a number of tone generation systems to be assigned or unassigned in response to detected key state changes. Economy in switch scanning is achieved by scanning groups of switches successively and interrupting group scanning only when a change in a key switch state is detected thereby effecting an average decrease in total scanning time. Wiring economy is achieved without the time rigidity inherent with time division multiplexing.

SUMMARY OF THE INVENTION

The foregoing objective is achieved by arranging keyboard switches in groups of P switches, Q such groups per set of switches, and S such sets of switches in a keying system. The keyboard switch detect and assignor system operates in two independent modes called search and assign. A complete search cycle in the search mode consists of sequentially scanning each group of switches. The search cycle is terminated at any time while the system is in the search mode by detecting that any key within any given switch group has changed state (opened or closed) since that group was scanned in a preceding search cycle. A group counter and division counter determine which particular group of switches is scanned interval of time. When any key state changes have been detected in a group of switches a HALT INC (halt increment) signal is generated which causes the group counter and division counter to retain their current states. HALT INC also causes the keyboard switch detect and assignor system to enter an assign mode and start an assign mode cycle.

During the assign mode cycle it is determined if each of the keys in the group being scanned has either been opened or closed since the preceding scan cycle. If a switch has been detected as having been opened, then a data word corresponding to such a switch is cleared in the assignment memory and that data word is designated as unassigned. If a switch has been detected as having been closed, a data word is assigned and the group counter, division counter, and note counter states are read into said data word. The note counter identifies a particular switch within a switch group.

If a newly closed switch has been detected and no data words are unassigned in the assignment memory, then such a switch state is automatically redesignated as unchanged since the last search cycle. At the conclusion of the assign mode, the search mode is again operable and restarts from the next search cycle state from that which had caused the transition to an assign mode.

The search cycle is not a fixed time but will vary according to the number of keyboard switches that have changed state since a preceding search cycle. If no switches are closed, then a scan cycle occurs in time QxSxt; where $t$ is the time normally used to search for a switch state change in a switch group. If any number of switches in a switch group have changed state, an assignment mode interval requires a time of 12xMxt, where m is the number of tone generators that can be assigned. M is also equal to the number of data words in the assignment memory. The time 12Mt is independent of the number of switches in a given group that may have changed switch states and thereby require a corresponding assignation operation.

Logic gates are used to provide both intramanual coupling (coupling between switch groups in the same set of switches) and intermanual coupling (coupling between corresponding switch groups in different sets of switches).

BRIEF DESCRIPTION OF THE DRAWINGS

A detailed description of the invention will be made with reference to the accompanying drawings wherein like numerals designate like components in the several figures.

DESCRIPTION OF THE PREFERRED EMBODIMENT

The following detailed description is of the best presently contemplated modes of carrying out the invention. This description is not to be taken in a limiting sense, but is made merely for the purpose of llustrating the general principles of the invention since the scope of the invention is best defined by the appended claims. Structural and operational characteristics attributed to forms of the invention first described shall also be attributed to forms later described, unless such characteristics are obviously inapplicable or unless specific exception is made.

Figure 1:
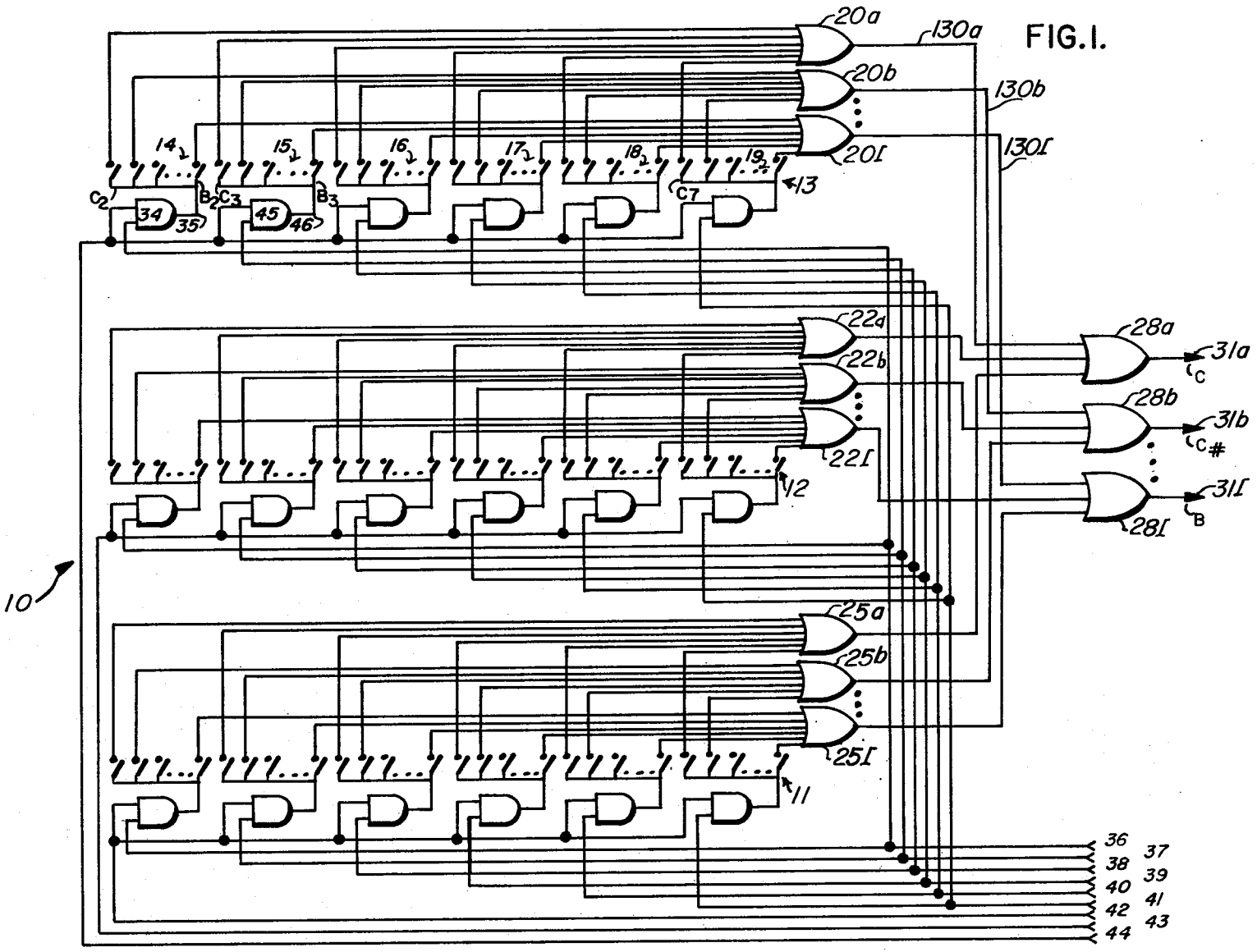
FIG. 1 is a connection diagram illustrating the partitioning of keyboard switches into groups and sets.
Figure 2:
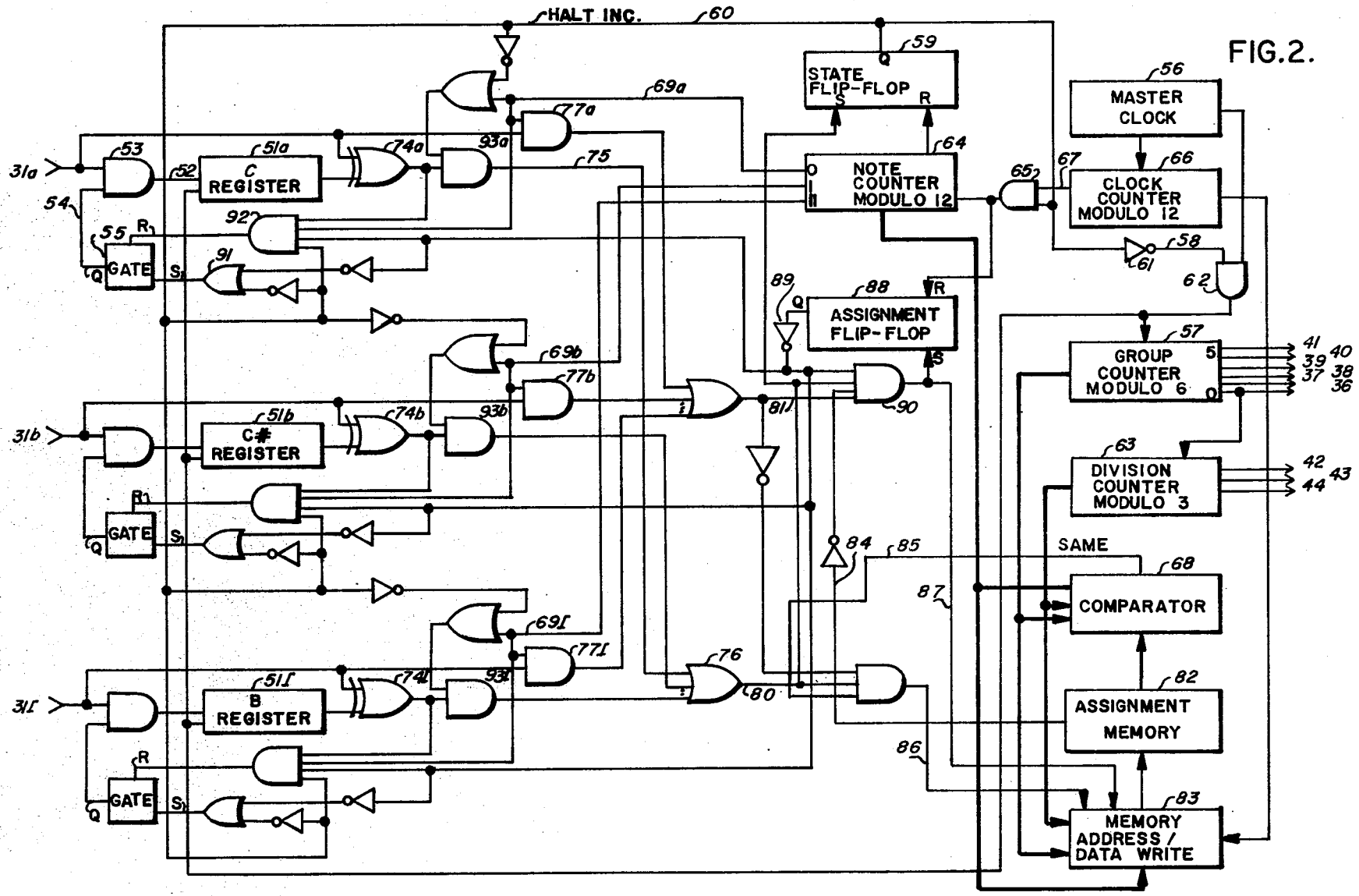
FIG. 2 is a logic and block diagram illustrating the state change detector and assignor.

The keyboard detect and assignor system 10 is shown in FIG. 1 and continued in FIG. 2. FIG. 1 illustrates the keyboard switch detect subsystem 10 of the invention while FIG. 2 illustrates the assign subsystem 50. The operation of system 10 is divided into two modes, or system operation phases. The first mode is called the search mode while the second mode is called the assign mode. During the search mode, the system continuously searches for a key state change in a programmed search pattern. When any key state change is detected, the system automatically is caused to terminate the search mode and enter the assign mode. In the assign mode several logical decisions are made. First, the system ascertains if a change of state has occured for any key detected to be closed on the current search mode, or for any key which was detected to be closed on the immediate preceding search scan. If a current search scan indicates a key closure not detected on an immediate prior search mode, then a new key closure has been detected. If a current search scan fails to indicate a key closure that had been detected on an immediate prior search scan, then a key opening has been detected. When a new key closure is detected, the particular key is identified and the identifying data information is stored in a memory. When a key opening is detected, the particular key is identified and the corresponding identification information is cleared from memory.

While the keyboard detect and assignor system 10 can be used for any keyboard musical instrument using switch closure information to control sound generation, the system operation is illustrated for an electronic organ. FIG. 1 shows three sets of keyboard switches; 11, 12, and 13. Each such set of switches corresponds to a keyboard, or to a division of the organ. For example; the set of switches 13 correspond to the swell division; the set of switches 12 correspond to the great division; and the set of switches 11 correspond to the pedal division. The names swell and great divisions are most commonly used for classical organs while the names upper and lower are frequently used for their counterparts in organs used for popular entertainment music.

Each set of division switches, such as set 12, is partitioned into a number of groups. For an organ, it is advantageous to have 12 switches in each group which then corresponds to the switches in an octave of twelve notes. FIG. 1 shows six groups of switches for each set of division switches. Thus the upper divisional switches 13, consist of the switch groups 14, 15, 16, 17, 18, and 19. Switch group 14 comprises switches for the lowest octave which is designated by the notes $C_2$, $C\#_2$, D, $D\#_2$, $E_2$, $F_2$, $F\#_2$, $G_2$, $G\#_2$, $A_2$, $A\#_2$, $B_2$. Switch group 19 comprises $C_7$ which is the highest note normally played on an organ keyboard. The remainder of the switches in switch group 19 can be used advantageously for other organ controls as described below.

The corresponding keys from each group are combined in an OR gate. Thus for upper division switch set 13: $C_2$, $C_3$, $C_4$, $C_5$, $C_6$, and $C_7$ are collectively inputs to OR gate 20*a*. Similarly, $C\#_2$, $C\#_3$, $C\#_4$, $C\#_5$, $C\#_6$ are collectively inputs to OR gate 20*b*; and $B_2$, $B_3$, $B_4$, $B_5$, $B_6$ are collectively inputs to OR gate 20*l*. Although not shown explicitly in FIG. 1, an OR gate is used to combine the remainder of the 9 notes in an octave as shown symbolically by dotted lines. The extra switches in switch group 19 are shown connected, although such switches need not be used in the construction of a particular musical instrument.

The switches for the switch groups in lower set 12 and pedal switch set 11 are connected in the same arrangement previously described for upper switch set 13. The output signals from OR gates 20*a*, 22*a*, and 25*a* are combined in C OR gate 28*a*. Thus an output signal on data line 31*a*, at any time during a search mode indicates that a C-key has been closed on some division of the organ. In the same fashion, the output signals from OR gates 20*b*, 22*b*, and 25*b* are combined in C # OR gate 28*b*. Thus a signal on data line 31*b*, at any time during a search mode indicates that a C # key has been closed on some division of the organ. Similarly the remainder of the OR gates are combined as shown symbolically by the dotted lines and shown explicitly for OR gates 201, 221, and 251 whose output signals are combined in B OR gate 281 to provide a signal on data line 311. There is an output OR gate similar to gates 28*a*, 28*b*, and 281 corresponding to each member of a group of switches.

An AND gate is connected to each group of switches. For example, AND gate 34 has an input from division time line 44 and from group time line 36. The signals on lines 36 and 44 are generated by means of the circuitry shown in FIG. 2 and described below. Line 35 will have a 1 signal during a search mode when both lines 36 and 44 simultaneously have a 1 signal. If during the time interval when line 35 has a 1 signal any switch in group 14 of division 13 is closed, then a 1 signal will be created at that time on one of the output lines 31*a*, 31*b*, . . . 311. (Nine additional lines are not explicitly drawn in FIG. 1 and they are symbolically represented by the dotted lines.)

AND gate 45 furnishes a 1 signal to switch group 15 of division 13 when there is simultaneously a 1 signal on time line 44 and group time line 37. If at such time, any switches are closed in switch group 15, then corresponding signals will appear on the output lines 31*a*, 31*b*, . . . , 311. Similar AND gates are used for each group of switches on division each division.

FIG. 2 depicts the detection and assignment logic 50. C register 51*a* is a memory containing 18 bits. The number of bits is equal to the total number of switch groups for all of the switch divisions of system 10 shown in FIG. 1, $T = 6 \times 3$. A similar memory is assigned for each note of an octave, or equivalently for each member of a switch group. Advantageously these memories are shift registers as shown in FIG. 2.

A 1 signal on line 52 signifies that on the current search scan a C-key was closed on one of the instrument's divisions and such a key switch has previously been assigned. The current 1 signal on line 31*a* is allowed to be entered into C register 51*a* by AND gate 53 if at the same time the second input to gate 53 on line 54 is a 1. The conditions under which line 54 is a 1 will be described below in conjunction with the assignment scan cycle.

Master clock 56 provides the timing signals for system 10 of FIG. 1 and system 50 of FIG. 2. The clock timing signals from master clock 56 are used to increment group counter 57 which is a counter modulo 6. Group counter 57 receives consecutive clock pulses from master clock 56 during the search mode. When the assign mode is initiated by setting state flip-flop 59, a 1 signal appears on line 60. This 1 signal is called HALT INC. Inverter 61, inverts the HALT INC signal to a 0 which causes AND gate 62 to inhibit the clock time signals from master clock 56. This inhibiting action freezes the current states of group counter 57 and division counter 63. At the same time, HALT INC signal enables note counter 64. State flip-flop 59 serves as a memory latch for the search mode and scan mode of the keyswitch system.

Figure 3:
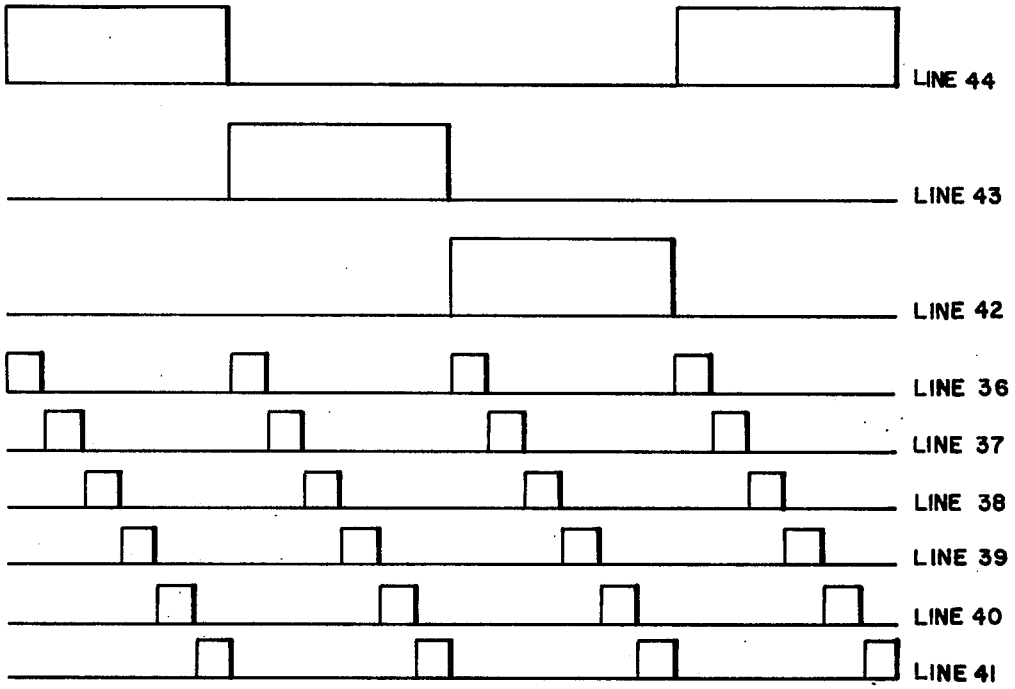
FIG. 3 shows the timing signals generated by the group and division counters.

Division counter 63 is a counter modulo 3 which is incremented by a signal called "the group reset signal" each time group counter 57 attains its zero state. Group counter 57 contains a decoder for decoding its binary states into integer states which are furnishes to system 10 via lines 36 to 41. The heavy lines denote output lines for the binary states of the counter. Division counter 63 contains a decoder for decoding its binary states into integer states which are furnished to system 10 via lines 42, 43, 44. FIG. 3 shows the timing sequence of the output integer states of group counter 57 and division counter 63.

Clock counter 66 is a counter modulo 12 which is continuously incremented by timing signals from master clock 56. Each time that clock counter 66 attains its zero state, a 1 signal appears on line 67. If system 50 is in its assign mode, then AND gate 65 will allow the signals on line 67 to increment note counter 64. Note counter 64 is a counter modulo 12. Its binary state output signals are indicated by heavy lines in FIG. 2. The integer states of note counter 64 appear on lines 69*a*, 69*b*, . . . , 691.

Addresses of shift registers 51*a*, 51*b*, . . . , 511 are incremented simultaneously by timing signals from the output of AND gate 62. Thereby these registers are incremented at the same time that group counter 57 is incremented and their states are frozen during an assign mode of operation when the state of group counter 57 is frozen. Only three shift registers are explicitly shown in FIG. 2. The extension to a set of more registers corresponding to the number of switches in a switch group shown in FIG. 1 is an apparent modification to those knowledgeable in the art.

The output signal from EX-OR gate 74*a* is a 1 if the signal detected for a C- switch on a given division set of switches for the current search cycle differs from the signal already stored in C-register 51*a* which resulted from the preceding search cycle. Gates 74*a*, 74*b*, and 74*l* are called identification gates.

For explanatory purposes, suppose that while system 50 is in its search mode, the switch corresponding to $C_3$ in group 15 of division 13 is closed. A signal will appear on line 31*a* at a time corresponding to the simultaneous occurance of signals on line 44 and line 37. If key switch $C_3$ had not been closed on the preceding search cycle, then a 1 signal will appear on line 75 at the time at which the switch detection signal appears on line 31*a*. OR gate 76 causes the signal on line 75 to be sent to state flip-flop 59. State flip-flop 59 is set and thereby places system 50 in its assign mode and causes group counter 57 and division counter 63 to retain, or freeze, their current search cycle states. System 50 will also be caused to end a search cycle and enter the assignment mode if key $C_3$ had been detected to have been opened on the current search cycle when it had been closed on the preceding search cycle. This action is initiated because the controlling logic is determined by whether or not the two inputs to EX-OR gate 74*a* are the same or are different. The same signals indicate no change in the detected switch states of key switch $C_3$, while different signals indicate a change in switch states. A change in switch states commands a responsive action for system 50 which must then go into its assign mode.

With system 50 now in its assign mode, note counter 64 is incremented by clock counter 66 because setting state flip-flop 59 has created HALT INC signal as previously described. Since the integer states of note counter 64 are generated sequentially at clock counter 66 rate, AND gates 77*a*, 77*b*, . . . , 771, 93*a*, 93*b*, . . . , 931 are thereby scanned successively in 12 time intervals. Therefore the assignment mode cycle is divided into 12 time assignment intervals such that each such time assignment interval is associated with a member of the switch group in which a key switch state change has been detected in the search cycle whose detection initiated the current assignment mode scan. During each such assignment interval, line 80 will have a 1 signal if the switch corresponding to the assignment interval, such as $C_3$ in the first interval, has had its state changed since the preceding search cycle. Line 81 will have a 1 signal if, and only if, the switch corresponding to note $C_3$ (for example) is closed on the current search cycle.

Assignment memory 82 is a read-write memory containing 12 data words whose contents represent the current assignment of each of a set of tone generators. Each word comprises 10 bits. The LSB (Least Significant Bit) denotes the assignment status of the corresponding tone generator. LSB will be 1 if the tone generator has already been assigned.

Bits 2, 3, 4 designate the group counter 57 state for the assigned note while bits 5, 6 designate the state of division counter 63. Bits 7, 8, 9, 10 designate the state of note counter 64 for the assigned note, or equivalently identifies the musical note within the octave designated by bits 2, 3, 4.

The contents of assignment memory 82 are read out into comparator 68 by means of address signals generated by memory address/data write 83. The address of the particular data word to be read from assignment memory 82 is determined by the states of clock counter 66. Thus during each assignment time interval, all the data words in assignment memory 82 are read out. The LSB of each data word read from assignment memory 82 is placed as a signal on line 84 to indicate whether or not the corresponding word being read to comparator 68 has already been assigned to a tone generator.

During an assignment cycle, each data word in assignment memory 82 is read sequentially into comparator 68. Comparator 68 also receives the current frozen states of group counter 57 and division counter 63 and the current state of note counter 64. A "SAME" signal is generated on line 85 by comparator 68 if the bits in positions 2 to 10 of a data word received from assignment memory 82 correspond to the current frozen states of the group counter and division counter.

The input signal on line 86 to memory address/data write 83 is 1 if, and only if, a key switch state has been detected as having been changed, if SAME signal appears on line 85, and the key switch is presently open. These conditions, for the illustrative example of the switch corresponding to note $C_3$, will all occur if the switch has just been detected on a search cycle as having been opened and if the corresponding previously assigned data word in assignment memory 82 has been addressed into comparator 68. If a 1 signal appears on line 86, memory address/data write 83 causes the word currently read from assignment memory to be reset to zero and the LSB will then indicate a nonassigned status to the data word.

The signal on line 87 is 1 when it has been detected that a key switch, such as the switch corresponding to note $C_3$, has changed its state and is now closed, and if the current word read from assignment memory 82 is unassigned. When line 87 is 1, memory address/data write 83 causes the current word addressed in assignment memory 82 to be written with a 1 in LSB and the frozen states of group counter 57 and division counter 63 and the current state of note counter 64 in bit positions 2 to 10.

Assignment flip-flop 88 and inverter 89 in combination with AND gate 90 causes line 87 to remain in a 1 signal state for a single master clock time interval during the corresponding assignment time interval. This logic is used to insure that a single keyboard switch is not assigned to more than one word in assignment memory 82. Assignment flip-flop 88 is reset at the end of each assignment time interval.

The purpose of gate flip-flop 55 is to control the gating of current data on line 31*a* into C register 51*a*. When system 50 is in its search mode, gate flip-flop 55 is always set and thereby allows data on line 31*a* to be transmitted to C-register 51*a*. The absence of HALT INC signal on line 60 in the search mode causes OR gate 91 to set gate flip-flop 55.

When system 50 is in the assignment mode, and a change in the state of a C-key has been detected, such as $C_3$, then during the corresponding assignment interval AND gate 92 causes gate flip-flop 55 to have the same state as assignment flip-flop 88. Thus at the end of an assignment cycle, the signal on line 54 will be 1 if either no change has been detected in the corresponding key switch state, or if a change was detected and an assignment was made. If such a change was detected and an assignment could not be made because all data words in assignment memory 82 had previously been assigned, then line 54 will be 0 and thereby will inhibit the storage of the corresponding detected switch closure signal. A 0 on line 54 is called the "full signal." Gate flip-flop 55 is also called at status counter. System 50 returns to the search mode when note counter 64 attains its zero state. This state change causes state flip-flop 59 to reset.

It is an obvious modification to use a shift register to implement assignment memory 82. The use of a shift register implementation is advantageous for musical instrument tone generation systems that employ time sharing of tone generation means such as the COMPUTER ORGAN described in U.S. Pat. No. 3,809,786.

Figure 4:
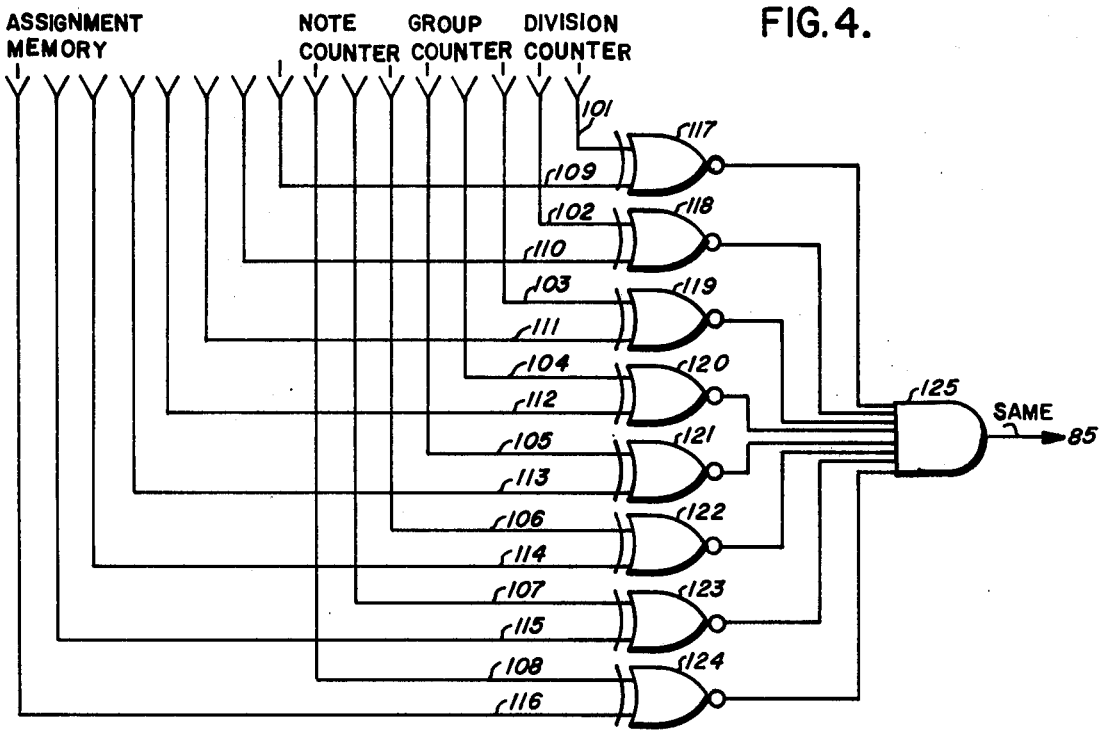
FIG. 4 is a logic diagram of a comparator.

FIG. 4 shows the gate logic comprising comparator 68. The data read from assignment memory 82 appears on lines 109 to 116. The division counter 63 binary state appears on lines 101 and 102; the group counter 57 binary state appears on lines 103, 104, 105; the note counter 64 binary state appears on lines 106, 107, 108. The EX-NOR gates 117 to 124 compare each signal from the three counters with the data word addressed from assignment memory 82. If all the compared bits are identical, then AND gate 125 generates SAME signal on line 85.

Figure 5:
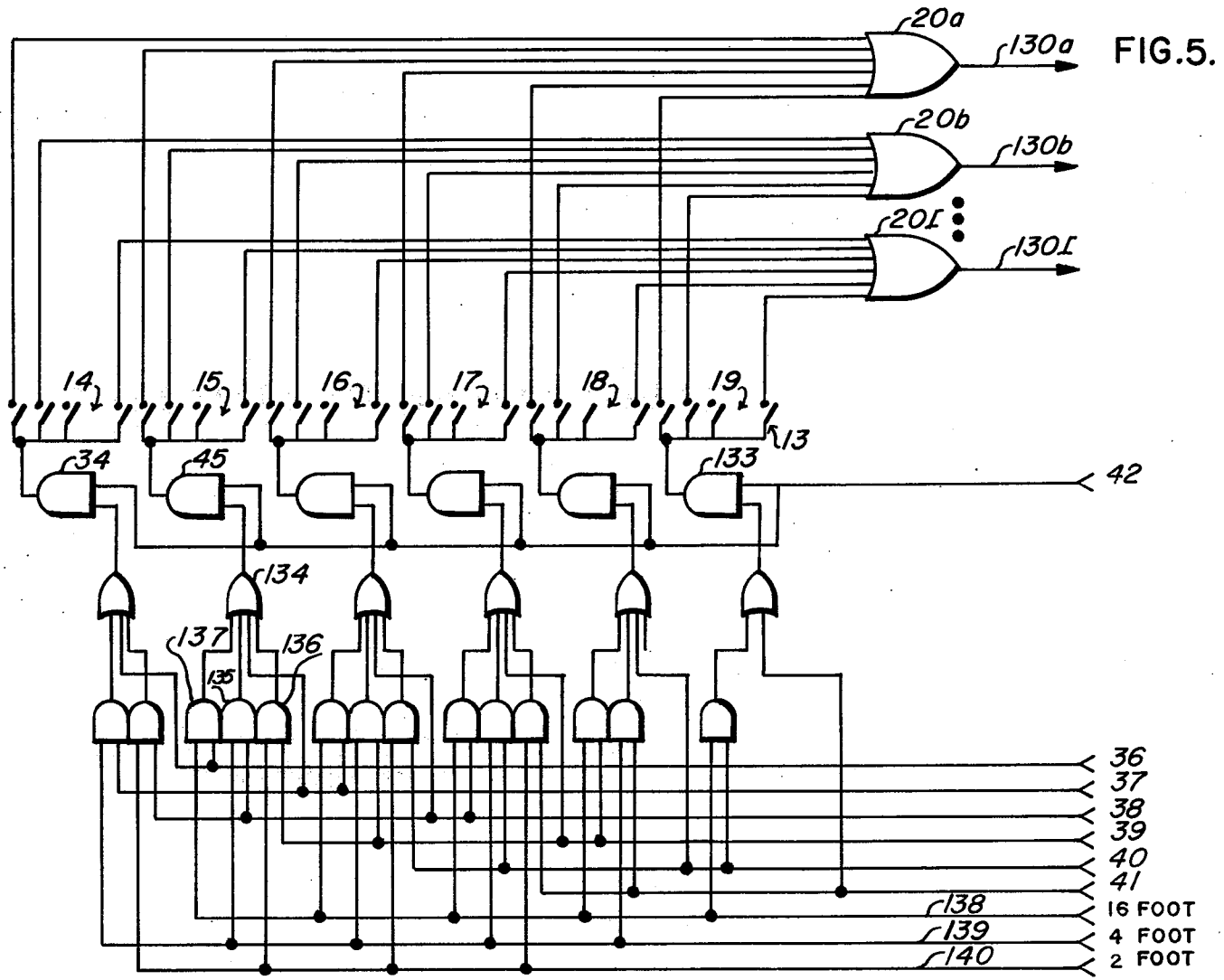
FIG. 5 illustrates logic gating to provide intramanual coupling.

FIG. 5 shows a means for the addition of intramanual coupling to division switches 13 for system 10 of FIG. 1. Intramanual coupling is conventionally used in keyboard musical instrument, such as organs, to mechanically or electrically interconnect keys switches on the same keyboard; or correspondingly on the same organ division. For example, a 4 foot, or octave coupler, will cause the closing of $C_3$ in group 15 to act as if $C_4$ in group 16 had been simultaneously closed. A 2 foot, or two octave, coupler will cause the closing of $C_3$ in group 15 to act as if $C_5$ in group 16 had been simultaneously closed.

Analogous a 16-foot, or suboctave, coupler will cause the closing of $C_3$ in group 15 to act as if $C_2$ in group 14 had been simultaneously closed.

Intramanual coupling, also called intradivisional coupling, is introduced in each switch group by an OR-gate and AND gates as exemplified by gates 134 to 137 acting in combination with group switch AND gate 45. In the absence of an enabling of control signal to any of the coupling gates 135, 136, 137 via corresponding control lines 138, 139, 140, the division AND gate 45 applies a 1 signal to switch group 15 when division state line 42 and switch group line 37 are simultaneously in a 1 state. If a 4-foot intramanual coupler is requested, then line 139 will be placed in a 1 state. When line 139 is 1 and switch group line 38 is 1, and division state line 42 is 1, then switch group 15 will have a 1 signal applied. The net result is that any switch closed in switch group 15 will produce an input signal in one of the OR gates 20*a* to 201 corresponding to the same signal that would have been produced by the closing of a similar switch in switch group 16.

If a 2-foot intramanual coupler is requested, then line 140 will be placed in a 1 state. When line 140 is 1 and group state line 39 is 1, and division state line 42 is 1, then switch group 15 will have a 1 signal. The net result is that any switch closed in switch group 15 will also produce the same signal output as if a corresponding switch had also been closed in switch group 17.

Similarly if a 16-foot intramanual coupler is requested, then line 138 will be placed in a 1 state. When line 138 is 1 and group state line 36 is 1, and division state line 42 is 1, then switch group 15 will have a 1 signal. The net result is that any switch closed in switch group 15 will also produce the same signal output as if a corresponding switch had also been closed in switch group 14.

The gates and coupling action is the same for switch groups 15, 16, 17. Switch group 18 does not have provision for a 2-foot coupler because such tones are normally beyond the range of tone generators in an organ. For the same reason switch group 19 is shown without a 4-foot and 2-foot coupler and switch group 14 is shown without a 16-foot coupler. The omission of these couplers represents a restriction of most organs and does not represent a limitation of this invention.

Figure 6:
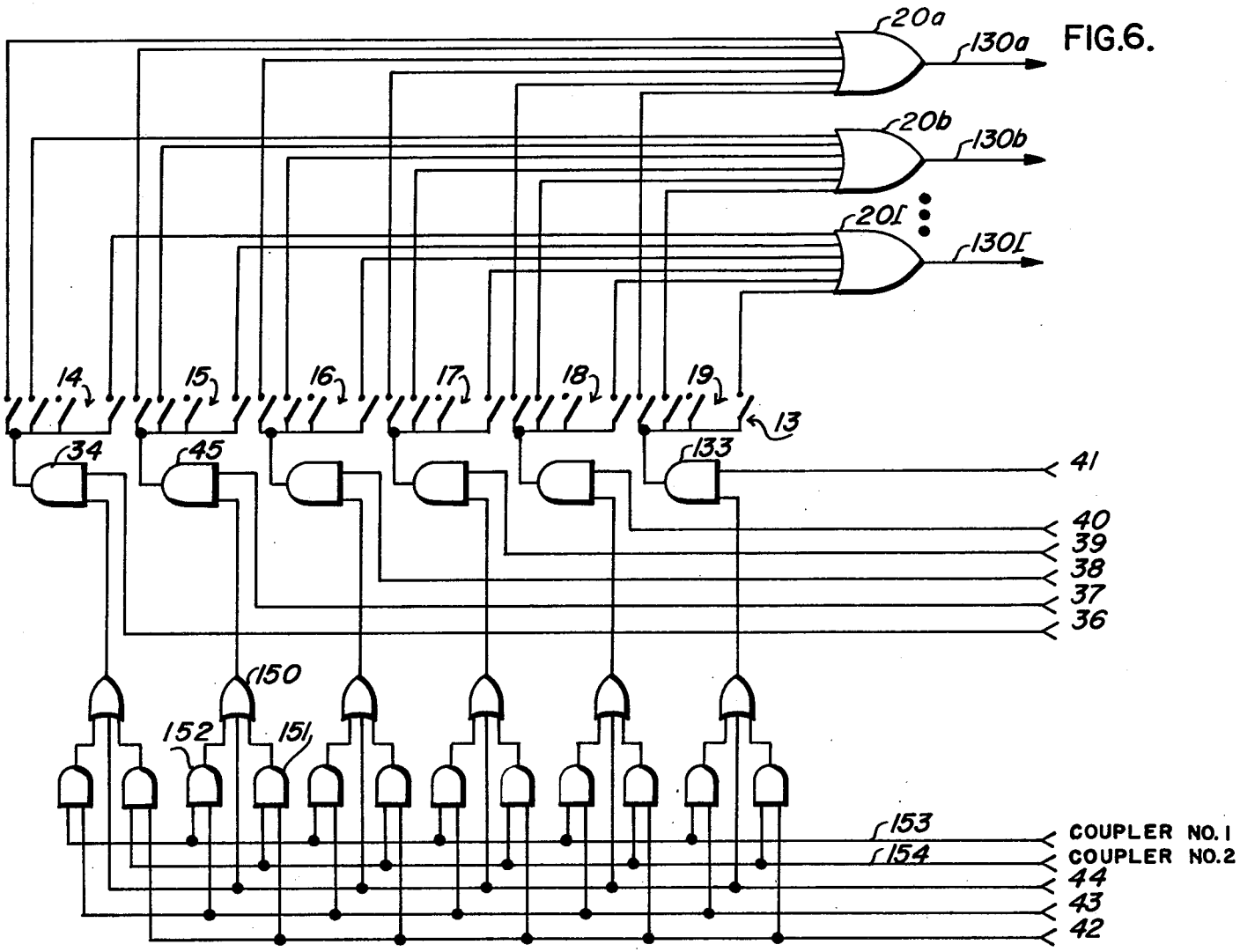
FIG. 6 illustrates logic gating to provide intermanual coupling.

FIG. 6 shows a means for the addition of interdivision couplers to division switches 13 for system 10 of FIG. 1. Interdivision couplers on a musical instrument are also called keyboard couplers, division couplers, or manual couplers. Interdivision couplers are used to cause the closing of a key on a given keyboard to also cause the closing of the corresponding key on one or more other keyboards of the musical instrument. For example, if $C_3$ in switch group 15 is closed, then the desired action is to have the same effect as if the switch $C_3$ had also been closed in the set of division switches 12 shown in FIG. 1.

The division coupling is explained for switch group 15 and is the same for other switch groups in division switches 13. AND gate 45 applies the 1 signal to switch group 15 when the group counter 57 applies a 1 to line 37 and a 1 exists on the second input to this AND gate. The second input to AND gate 45 will always receive a signal for the division set of switches as furnished by division counter 63 on line 44.

If a coupler is desired to switch set 12, then a 1 signal is furnished on line 153. Now AND gate 152 furnished a signal to AND gate 45 via OR gate 150 when division counter 63 generates a 1 signal on line 43. Since this division counter state corresponds to the signal applied to division switch set 12, the closure of a switch in switch group 15 will also create a second signal corresponding to the closure of a corresponding switch in division switch set 12. In a similar manner, if a coupler is desired to switch set 11, then a 1 signal is furnished on line 154. This control signal cause AND gate 151 to send a signal to AND gate 45 via OR gate 150 when division counter 63 generates a 1 signal on line 42. Since this division counter state corresponds to the signal applied to division switch set 11, the closure of a switch in switch group 15 will also create a second signal corresponding to the closure of a corresponding switch in division switch set 11.

The extension of intramanual and interdivisional couplers to the other division sets of switches is apparent to those skilled in the art.

The invention is not limited to six octaves and includes arrangements of P switches in a group, Q groups in a set, and S sets. For an organ it is advantageous to have P=12, Q=6 and S=3. The number of assigned tone generators is not limited to 12 which was used for explanatory purposes in the description of system 50 in FIG. 2. Any number can be used which can be less than, equal to, or greater than the number $P \times Q$. The number 12 is advantageous for a musical instrument because it is equal to the number of the musicians' fingers and two feet.

The KEYBOARD SWITCH DETECT AND ASSIGNOR of the subject invention is advantageously used in musical instrument tone generating systems such as the copending application POLYPHONIC TONE SYNTHESIZER, document Number 603776. A tone generator means, such as a variable frequency clock, can be assigned to each data word in assignment memory 82. A 0 in LSB would inhibit such tone generator so that no musical waveshape is produced when the data word is assigned. A 1 in LSB causes such tone generator to produce musical waveshapers, the frequency of the generated waveshape is determined by the data word bits designating the octave and note within the octave assigned thereby to a tone generation means. The nature of the musical waveshape being determined by the assignment of the one generator to a particular keyboard and to the tone colors available for that keyboard.

The KEYBOARD SWITCH DETECT AND ASSIGNOR of the subject invention may be employed with any type of utilization means, but is particularly useful with an electronic keyboard musical instrument of the type described in U.S. Pat. No. 3,809,786 to Deutsch entitled COMPUTER ORGAN. In that instrument, the fundamental frequency of each generated musical note is established by a frequency number selected from a set of such numbers stored in a memory. The timbre or tonal quality of the note is established by a set of stored harmonic coefficients which determine the relative amplitudes of the Fourier components constituting the generated musical waveshape. Several sets of such harmonic components may be stored separately and chosen for utilization by stop selection switches. Attack and decay are implemented digitally by programmatically scaling the amplitudes of the constituent Fourier components during successive note generation cycles. When the subject invention is used with such a COMPUTOR ORGAN, the data contained in the assignment memory is used as an addressing code to establish the frequency for the tone generating means by reading frequency numbers from the memory. In the same fashion, words stored in the assignment memory can be used to identify tone controls and cause the appropriate corresponding sets of harmonic coefficients to be used by the tone generating means.

The data stored in the assignment memory can be used to address frequency numbers in the manner used in the COMPUTER ORGAN. A digital-to-analog convertor can be used to convert these numbers and to generate voltages corresponding to the fundamental frequency of a keyboard switch. These voltages in turn can be used to determine the frequency of a voltage controlled oscillator which are advantageously used in the copending U.S. patent application Ser. No. 603,776 entitled POLYPHONIC TONE SYNTHESIZER.

Using the inventive system, newly actuated and released switches are rapidly detected, and wiring between the keyboards and other musical instrument circuitry is simplified.

The subject invention is not limited to musical instrument tone generating systems and is applicable to the assignment of a set of control functions operable from an array of switches arranges in groups. In particular, the invention is applicable to the stop switches, or tonal controls, used with keyboard musical instruments.

Intending to claim all novel, useful and unobvious features shown or described, the applicants make the following claims:

1. A keyboard switch system comprising:

a plurality of switches arranged in groups, a plurality of said groups comprising a set, a plurality of said sets comprising a keying system, first means for operating said keying system in a search mode, detection means responsive to said first means for detecting a change of switch states in said groups, second means responsive to said detection means for operating said keying system in an assign mode, identifying means responsive to said second means for generating signals identifying switches in said groups detected by said detection means to have changed state and whereby identification data is created, assignment memory means for storing said identification data to be thereafter read out, assignor means including means responsive to said identifying means for transferring said identification data corresponding to a switch in new closed state detected by said detection means into said assignment memory means, said means responsive to said detection means for clearing identification data from said assignment memory means corresponding to a switch in new open state detected by said identification means, and whereby identification data corresponding to switch in new closed state is not read into said assignment memory means when all assignment words are assigned.

signal generation means whereby a full signal is created when all said assignment words are assigned, and third means responsive to said assignor means whereby said keying system is caused to terminate operation in said assign mode and to return to said search mode when said identification data is cleared or stored for all switches detected as having changed state.

2. A keyboard switch system according to claim 1 wherein said plurality of the number of switches arranged in each group is a number P, wherein the number of said plurality of groups in a set is Q, and the number of said sets is a number R, and said first means comprises;

clock means for creating clock time signals, scan gating means for transferring said clock time signals when said keying system is in said search mode and for inhibiting said clock time signals when said keying system is in said assign mode, a group counter incremented by said clock time signal transferred by said scan gating means wherein the group counter is modulo said number Q, the contents of said group counter designating a switch group within a set, the group counter generating a group reset signal when a clock time signal causes said group counter to return to its initial count state, a division counter incremented by said group reset signal wherein the division counter is modulo R, the contents of said division counter designating a set within said keying system, and first gating means connected to the output of said group counter and said division counter for scanning the switch groups in each of the sets in sequence in synchronism with said clock means whereby switches in each group are pulsed by clock means to form a pattern of data signals for each group of switches.

3. A keyboard switch system according to claim 2 wherein said detection means comprises;

combination means whereby data signals created by said first gating means in response to switch states of corresponding switches in each of said groups are combined on a common data line, a plurality of memory means for writing said data signals on each said common data line into a corresponding memory to be thereafter read out, the number S of such memories corresponding to the number P of switches in each of said groups, means for causing said data signals to be written into said memory means whereby said data signals are caused to be written for an open switch state in response to said full signal, first addressing means for causing data to be read from said memory means, said data corresponding to said data signals written during prior search cycles, first comparator means for comparing said data signals from said combination means with previously written data signals read from said memory means in response to said first addressing means and generating a halt increment signal if said compared data differ, and means responsive to said halt increment signal from said first comparator means for causing said second means to operate in said assign mode.

4. A keyboard switch system according to claim 3 wherein said clock means comprises;

a master clock means for creating clock time signals, a clock counter incremented by said clock signals wherein clock counter is modulo said number S, second gating means whereby contents of said clock counter are caused to be transferred in response to said halt increment signal, a note counter incremented each time said clock counter returns to its initial state, wherein note counter is modulo said number s and whereby a reset signal is created when note counter is caused to return to its initial state, and means responsive to said scan gating means whereby said clock time signals are transferred to said first addressing means causing data read thereby to correspond to switch states in said search cycle.

5. A keyboard switch system according to claim 3 wherein numbers $p_q$, for $q=l$ to Q designate switch groups in a plurality Q of such switch groups and wherein said first gating means further comprises;

first control signal means wherein a plurality of first control signals are created and whereby each such control signal designates an increment in said number $p_q$, third gating means responsive to said first control signals causing states created from contents of said group counter to be transferred such that each said transferred state corresponds to one said incremented number $p_q$, and first signal adding means wherein said states transferred by said third gating means are combined and transferred to said first gating means whereby contents of said group counter and said division counter cause said switch groups to be scanned sequentially and whereby said first control signals causes switches within a particular switch group p to be multiply scanned such that a closure of a switch in said group p also causes signals to be created corresponding to those that would have been created by corresponding switch closures in groups within set Q corresponding to said increments in number $p_q$.

6. A keyboard switch system according to claim 3 wherein number $P_q$, for $q=l$ to Q designates a switch group in a set of number Q switch groups, wherein number r designates a particular member of said plurality of sets of switch groups of number R, and wherein first gating means further comprises;

second control signal means wherein a plurality of second control signals are created and whereby each such control signal designates an increment in said number *r*, fourth gating means responsive to said control signals causing states created from contents of said division counter to be transferred such that each said transferred state corresponds to one said incremented number *r*, and second signal adding means for combining said states transferred by said fourth gating means with states created from contents of said division counter and for transferring combination of states to said first gating means thereby causing contents of said group counter and said division counter to sequentially scan said switch groups and sets of switch groups and whereby said second control signals cause switches within switch group $P_q$ to be multiply scanned thereby also creating a signal associated with the corresponding closure of a switch within group $P_q$ in a set of switch groups designated by said increment number *r*.

7. A keyboard switch system according to claim 4 wherein said second means comprises;

memory latch comprising two states wherein first state creates said halt increment signal and wherein second state inhibits creation of halt increment signal, first circuitry means responsive to said compared data for setting said memory latch in said first state if the compared data is not equal, and second circuitry means whereby said reset signal created by said note counter causes said memory latch to be placed in said second state.

8. A keyboard switch system according to claim 7 wherein said identifying means comprises;

first comparator means further comprising S number of identification gates, and a means responsive to states of said note counter for sequentially scanning said identification gates thereby causing said compared data to be sequentially compared, means for transferring the state of said note counter to said assignor means identifying said data signals with corresponding members of said number of S of plurality of switches in said groups, and identification data means for combining said transferred states of said note counter with contents of said group counter and said division counter to create said identification data.

9. A keyboard switch system according to claim 8 wherein said assignor means comprises;

second addressing means for causing said identification data written into said assignment memory means to be read out responsive to said means for transferring the state, second comparator means wherein said identification data read out by said second addressing means is compared with identification data created by said identification data means and whereby a same signal is created if said compared data are identical, second circuitry means responsive to combination of said same signal, said full signal and said data signal created by said first comparator means including means for resetting said assignment word read by said second addressing means to zero value if said data signal is created as a result of a switch state transition from closed to open, means for replacing said assignment word read by said second addressing means by said identification data created by said identification data means if the least significant bit of said assignment word has a zero value and if said data signal is created as a result of a switch state transition from open to closed and said full signal is not created, and means for setting the least significant bit to a one value in response to said replacing means, and third circuitry means responsive to said signal generation means whereby generation of said full signal causes said means for causing to write said data signal into said memory means as a data signal with a zero value least significant bit corresponding to an open switch state.

10. A keyboard switch system according to claim 9 wherein said signal generation means comprises;

a number S of gate flip-flop, an assignment flip-flop set by a data signal corresponding to a closed switch state and reset at the end of each assignment time interval thereby generating a signal during a single master clock time interval, fourth circuitry means responsive to signal generated by said assignment flip-flop whereby said assignor means is caused to assign a single word in said assignment memory means responsive to each detected closed switch state, and fifth circuitry means responsive to said assignment flip-flop whereby said gate flip-flop is caused to have same state as assignment flip-flop and whereby said full signal is created if all words in said assignment memory means have been assigned.

11. A keyboard switch system according to claim 10 wherein said third means comprises;

fourth sixth circuitry means responsive to said note counter whereby said reset signal is created when said note counter is caused to return to its initial state, and seventh circuitry means whereby said reset signal causes said memory latch to be placed in said second state and thereby causing said first means to be operative.

12. A keyboard musical instrument incorporating a keyboard switch system, said musical instrument having keyboard actuated note selection switches and other switches controlling the characteristics of musical sounds generated by said musical instrument, said keyboard and other switches being arranged in groups of S switches, Q groups of S switches arranged in a division set, and R such division sets, said system comprising;

first means for operating said system in search mode, detection means responsive to said first means for detecting change of switch stated in said groups, second means responsive to said detection means whereby said system is operated in assign mode, identifying means responsive to said second means for identifying switches in said groups detected to have changed state and whereby identification data is created, assignment memory means for writing said identification data to be thereafter read out, assignor means responsive to said identification means whereby identification data corresponding to switch in new closed state detected by said identification means is read into said assignment memory means, whereby identification data corresponding to switch in new open state detected by said identification means is cleared from said assignment memory means, and whereby identification data corresponding to switch in new closed stated is not read into said assignment memory when all assignment words are assigned, signal generation means whereby a full signal is created when all said assignment words are assigned, third means responsive to said assignor means whereby said system is caused to terminate operation in said assign mode and thereby causing said first means to be operative, and reading means whereby said identification data read from said assignment memory means is supplied to said musical sound generation circuitry for utilization thereby.

13. A keyboard musical instrument according to claim 12 wherein said musical sound generation circuitry comprises a memory storing frequency numbers determinative of the fundamental frequency of said generated musical sound, said identification data resultant from actuation of said note selection switches corresponding to addresses of said frequency number memory.

14. A keyboard musical instrument according to claim 12 wherein said musical sound generation circuitry comprises frequency circuitry means for creating a clock rate determinative of the fundamental frequency of said generated musical sound.

15. A keyboard musical instrument according to claim 13 further comprising;

means for converting said frequency numbers to frequency voltages, and, circuitry means for generating clock rates responsive to said frequency voltages for utilization thereby by said sound generation means.

16. A keyboard control for a musical instrument in which musical sounds are generated in response to activation of the keyboard switches, the keyboard switches corresponding to notes being arranged in groups corresponding to musical octaves, the groups being arranged in divisions corresponding to different keyboards, said keyboard control comprising;

a storage means for simultaneously storing data identifying the note, group, and division of a predetermined number of keyboard switches, identifying means responsive to actuation of any of said keyboard switches for generating signals identifying the note, group and division of the actuated keyboard switches, means sensing if said storage means is storing data for less than said predetermined number of keyboard switches, means responsive to said sensing means for transferring data in response to the key identifying signals to said storage means only when the storage means contains data on less than said predetermined number of keyboard switches, and means responsive to release of any of said keyboard switches for clearing the corresponding identifying data from said storage means.

17. Apparatus according to claim 16 further comprising;

group scanning means scanning said groups of keyboard switches at a predetermined rate, and means interrupting said group scanning means whenever any keyboard switch within a group changes status.

18. Apparatus according to claim 17 further comprising;

key scanning means responsive to the interruption means for sequentially scanning said keyboard switches in a group when the status of a keyboard switch in a group has caused the group scanning means to be interrupted.

19. Apparatus according to claim 18 wherein the group scanning means and the keyboard switch scanning means further comprise counters counting in synchronism with the scanning sequence, and said identifying means generates said signals in response to the count condition of the counters.

20. A control circuit for a keyboard operated musical instrument in which the keys are arranged in groups corresponding to the notes in an octave, comprising;

means repeatedly scanning the groups of keys sequentially, means for interrupting the scanning means in response to a change in status of any key within a group from the status in the previous scanning cycle, memory means for storing data identifying the group and note within the group of a plurality of keys simultaneously, means responsive to said interrupting means for generating data signals identifying each note within the group and the group in which the corresponding key has been activated since the previous scanning cycle, means transferring said data signals to said memory means, and means responsive to the interrupting means for clearing data signals stored in the memory means for each note within the group in which the corresponding key has been released since the previous scanning cycle.

21. Apparatus according to claim 20 further comprising;

interrupting means including key status memory means storing the status of each key of the musical instrument, means synchronized with the group scanning means for simultaneously comparing the current status of each key in a group as the group is scanned with the status of the corresponding group of keys stored in said key status memory means, and said interrupting means said interrupting the scanning means when the comparing means indicates a change in status of a key.

22. Apparatus according to claim 21 further comprising means for changing a key status in said key status memory means whenever key identification signals for the corresponding key are stored in said memory means.

* * * * *